United States Patent [19]

Edwards

[11] Patent Number: 4,509,316

[45] Date of Patent: Apr. 9, 1985

[54] LAWN MOWER SHARPENER

[76] Inventor: Jack F. Edwards, 4917 Harrison Dr., Holiday, Fla. 33590

[21] Appl. No.: 637,609

[22] Filed: Aug. 3, 1984

[51] Int. Cl.[3] ..... B24B 19/00

[52] U.S. Cl. ..... 56/250; 51/250; 51/288; 76/82.1

[58] Field of Search ..... 56/250; 51/211 R, 250, 51/288; 76/82.1

[56] References Cited

U.S. PATENT DOCUMENTS

| | | | |
|---|---|---|---|
| 3,225,527 | 12/1965 | Spear | 56/250 |
| 3,596,412 | 8/1971 | Brayman | 76/82.1 |
| 3,636,666 | 1/1972 | Brayman | 56/250 |
| 3,659,385 | 5/1972 | Ferguson | 56/250 |

*Primary Examiner*—Gene Mancene
*Assistant Examiner*—David L. Tarnoff
*Attorney, Agent, or Firm*—Stanley M. Miller

[57] ABSTRACT

An improved rotary, power lawn mower sharpener is disclosed which includes a base member having a lever pivotally mounted thereon for horizontal motion and having a handle for actuating the lever. The sharpener further includes a wedge having a horizontal, planar, bottom surface for sliding engagement with the upper surface of the base, and having an inclined, planar, upper surface, the wedge connected by means of a link element to the lever, the lever acting to displace the wedge in a horizontal direction. A tray member is pivotally mounted by means of a horizontal pivot, the tray having a planar, bottom surface adapted for sliding engagement with the inclined, upper surface of the wedge when the wedge is moved horizontally by the lever. A grinding stone is mounted in the tray, having an upper, planar grinding surface which is raised when the wedge moves inwardly beneath the tray and which is lowered when the wedge is moved outwardly from beneath the tray. In operation, the base member is positioned beneath a rotary power lawn mower by rolling the wheels of the mower over the base and moving the handle so that the lever pulls the wedge outwardly from beneath the tray member, lowering the grinding stone so that the upper surface thereof clears the bottom edge of the mower. In further operation, the blade is sharpened by moving the handle so that the lever pushes the wedge inwardly beneath the tray member, raising the grinding stone to operatively contact the moving blade.

10 Claims, 3 Drawing Figures

LAWN MOWER SHARPENER

FIELD OF THE INVENTION

The invention disclosed broadly relates to blade sharpening devices and more particularly relates to improvements in lawn mower sharpeners.

BACKGROUND OF THE INVENTION

The primary technique for sharpening the blade of a power lawn mower is to remove the blade from the machine and then to apply a file or grinding stone to sharpen the blade edge. This is a time consuming task and can result in the unbalancing of the blade by removing too much of the blade's material on one if its sides.

One approach in the prior art to reducing the labor involved in sharpening the blades on rotary power lawn mowers has been to mount the sharpening device on the body of the mower. U.S. Pat. No. 3,225,527 is an example. Although this mode is convenient to the operator, it results in excessive wear on the blade because of the inherent imprecision of this type of device. Stationary sharpening devices have also been tried in the prior art, requiring the mower to be brought to the sharpening station. U.S. Pat. No. 3,596,412 is an example. With the power of the mower's motor applied to the rotating blade, the blade is brought into contact with the grinding stone at the station. Although this form of device provides a more controlled application of the grinding stone to the blade and therefor a better quality sharpening operation, the operator is confronted with the inconvenience of taking the mower to the sharpener, instead of taking the sharpener to the mower. Furthermore, this fixed-base type of prior art sharpener typically has many moving parts requiring excessive maintenance. Portable sharpeners are also available in the prior art, which do not mount onto the mower. U.S. Pat. No. 4,285,169 is an example. However, this type device relies on the vacuum developed by the rotary mower's blade and is inherently imprecise in its operation.

OBJECTS OF THE INVENTION

It is therefor an object of the invention to provide an improved sharpener for a rotary power lawn mower.

It is another an object of the invention to provide an improved sharpener for a rotary power lawn mower which is both portable and precise in its operation.

It is a further object of the invention to provide an improved sharpener for a rotary power lawn mower which has the precision of a fixed-station sharpening device but which is both portable and which has fewer moving parts than the prior art.

SUMMARY OF THE INVENTION

These and other objects, features and advantages are accomplished by the invention disclosed herein. An improved rotary, power lawn mower sharpener is disclosed which includes a base member having a lever pivotally mounted thereon for horizontal motion and having a handle for actuating the lever. The sharpener further includes a wedge having a horizontal, planar, bottom surface for sliding engagement with the upper surface of the base, and having an inclined, planar, upper surface, the wedge connected by means of a link element to the lever, the lever acting to displace the wedge in a horizontal direction. The sharpener further includes a tray member pivotally mounted by means of a horizontal pivot, the tray having a planar, bottom surface adapted for sliding engagement with the inclined, upper surface of the wedge when the wedge is moved horizontally by the lever. The sharpener further includes a grinding stone mounted in the tray, having an upper, planar grinding surface which is raised when the wedge moves inwardly beneath the tray and which is lowered when the wedge is moved outwardly from beneath the tray. In operation, the base member is positioned beneath a rotary power lawn mower by rolling the wheels of the mower over the base and moving the handle so that the lever pulls the wedge outwardly from beneath the tray member, lowering the grinding stone so that the upper surface thereof clears the bottom edge of the mower. In further operation, the mower having a rotary blade with a leading edge which is to be sharpened, the blade is driven into horizontal motion by means of its motor, the blade is sharpened by moving the handle so that the lever pushes the wedge inwardly beneath the tray member, raising the grinding stone so that the upper surface thereof operatively contacts the lower surface of the leading edge of the blade at an inclined angle. In this manner, the blade is conveniently and safely sharpened. The invention combines the feature of portability with a precision operating characteristic and it has a minimum number of moving parts.

DESCRIPTION OF THE FIGURES

These and other object, features and advantages of the invention will be clearer to the reader with reference to the Figures which are enumerated as follows.

DISCUSSION OF THE PREFERRED EMBODIMENT

Figure 1:
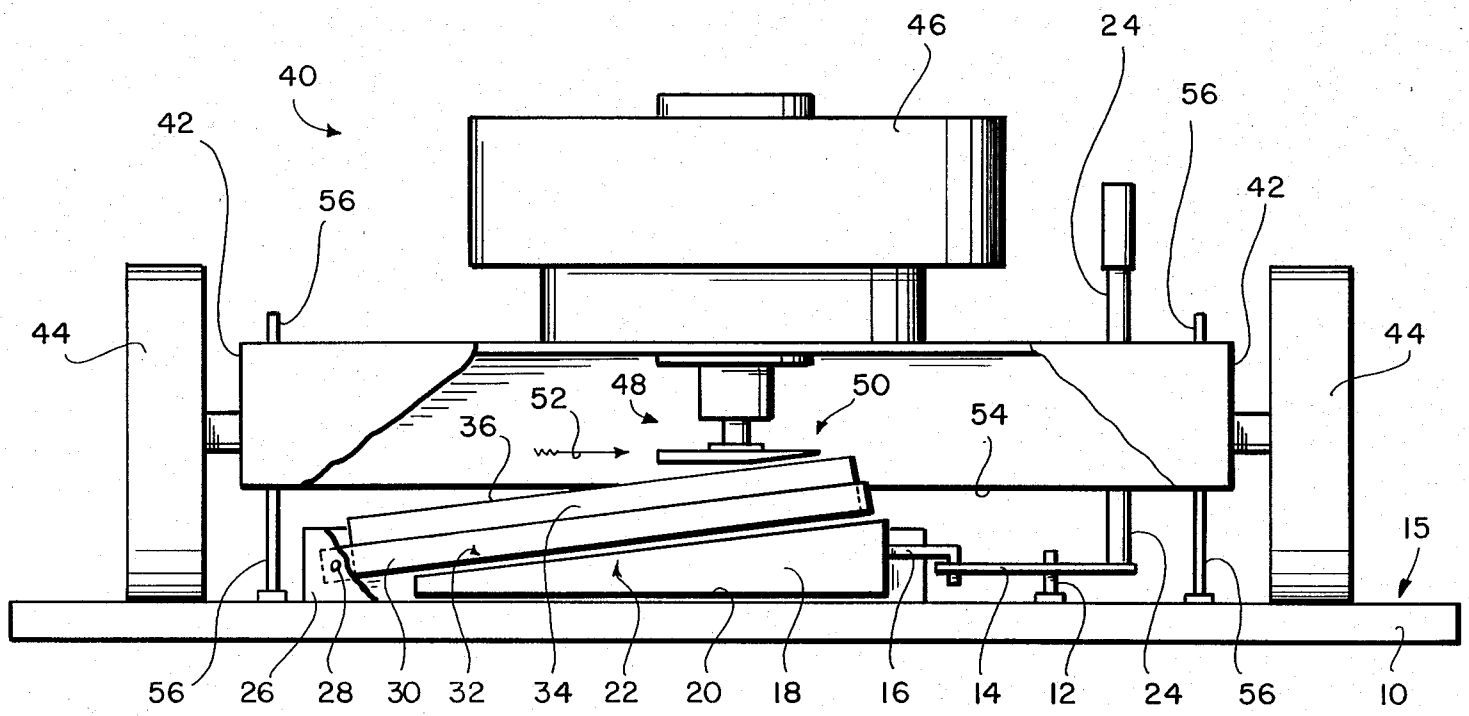
FIG. 1 is a rear, break-away view of the invention, showing the grinding stone 34 in its raised position for sharpening the blade of a rotary power lawn mower.
Figure 2:
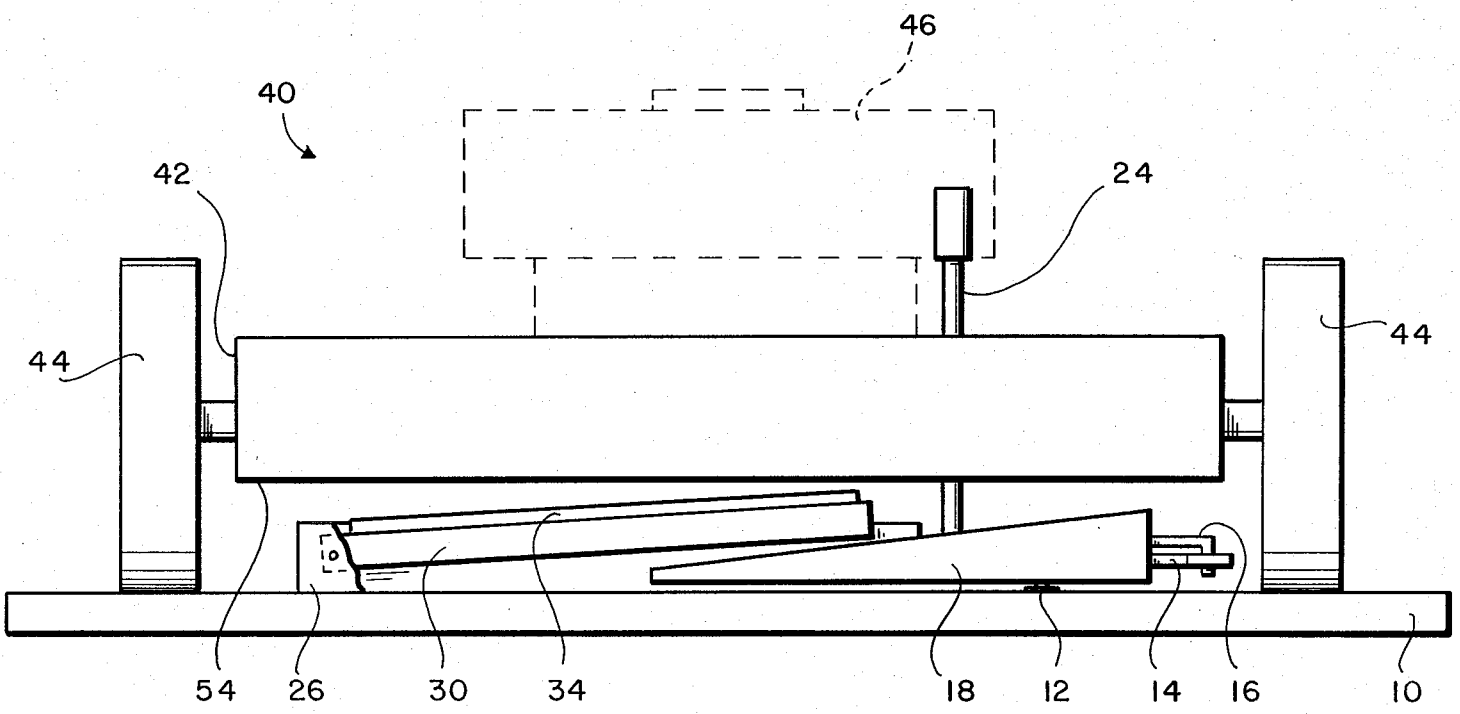
FIG. 2 is similar to FIG. 1, but shows the grinding stone 34 in its lowered position to enable the mower to move away from the sharpener.
Figure 3:
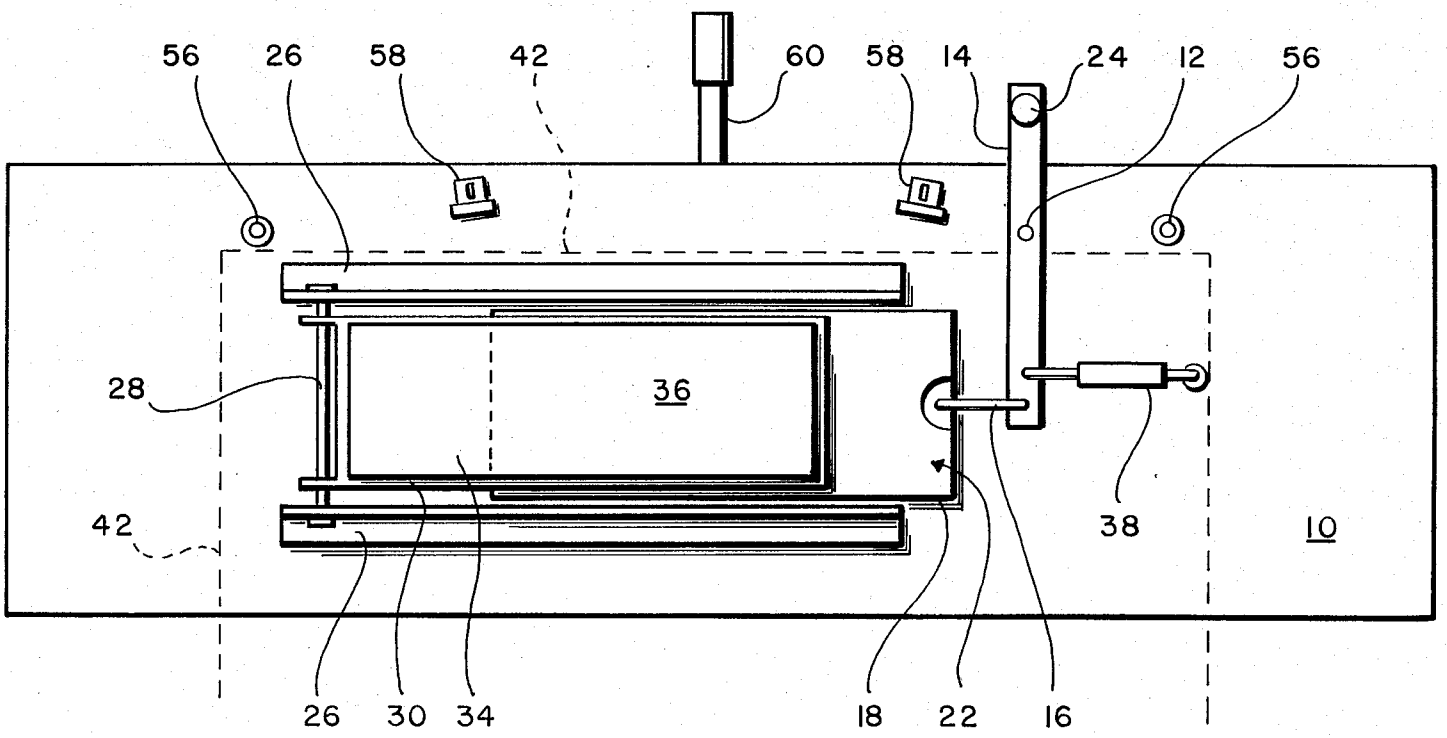
FIG. 3 is a top view of the invention.

The invention is shown in FIGS. 1, 2 and 3. FIG. 1 is a rear, break-away view of the invention, showing the grinding stone 34 in its raised position for sharpening the blade of a rotary power lawn mower. FIG. 2 is similar to FIG. 1, but shows the grinding stone 34 in its lowered position to enable the mower to move away from the sharpener. FIG. 3 is a top view of the invention.

The improved rotary, power lawn mower sharpener includes a base member 10 having a vertical pivot pin 12 mounted on an upper, horizontal surface 15 thereof.

A lever 14 is pivotally mounted on the pivot pin 12 for horizontal motion about the pivot pin 12, having a handle 24 connected thereto for actuating the lever 14.

A wedge 18 has a horizontal, planar, bottom surface 20 for sliding engagement with the upper surface 15 of the base 10, and has an inclined, planar, upper surface 22, the wedge 18 connected by means of a link element 16 to the lever 14, the lever 14 acting to displace the wedge 18 in a horizontal direction.

A pair of guide rails 26 are mounted on the upper surface 15 of the base 10, the rails 26 being parallel and spaced apart forming a trough in which the wedge 18 can slide horizontally between the rails 26.

A tray member 30 is pivotally mounted between the pair of rails 26 by means of a horizontal pivot 28, the tray 30 having a planar, bottom surface 32 adapted for sliding engagement with the inclined, upper surface 22 of the wedge 18 when the wedge 18 is moved horizontally by the lever 14.

A grinding stone 34 is mounted in the tray 30, having an upper, planar grinding surface 36 which is raised when the wedge 18 moves inwardly beneath the tray 30 and which is lowered when the wedge 18 is moved outwardly from beneath the tray 30.

The base member 10 is positioned beneath a rotary power lawn mower 40 by rolling the wheels 44 of the mower 40 over the base 10 and moving the handle 24 so that the lever 14 pulls the wedge 18 outwardly from beneath the tray member 30, lowering the grinding stone 34, as shown in FIG. 2, so that the upper surface 36 thereof clears the bottom edge 54 of the mower 40.

The mower 40 has a rotary blade 48 with a leading edge 50 which is to be sharpened, the blade being driven into horizontal motion 52 by means of its motor 46. The blade 48 is sharpened by moving the handle 24 so that the lever 14 pushes the wedge 18 inwardly beneath the tray member 30, raising the grinding stone 34, as shown in FIG. 1, so that the upper surface 36 thereof operatively contacts the lower surface of the leading edge 50 of the blade 48 at an inclined angle.

In this manner, the blade 48 is conveniently and safely sharpened.

A spring means 38 connected between the lever 14 and the base member 10, provides for spring biasing the wedge 18 outwardly from beneath the tray 30.

In a first embodiment, at least one stop element 56 is mounted on the base 10 in spaced relation to the rails 26, for contacting the side 42 of the mower 40, to horizontally position the mower 40 and its blade 48 with respect to the horizontal position of the grinding stone 34.

In a second embodiment, a pair of adjustable stop elements 58 are mounted on the base 10 in spaced relation to the rails 26, for contacting the side 42 of the mower 40, to horizontally position the mower 40 and its blade 48 with respect to the horizontal position of the grinding stone 34.

The pair of stop elements 58 are variably positionable on the base member 10 to accomodate a variety of shapes for the side 42 of the mower 40.

A base handle 60 can be mounted to the base member 10, for enabling the operator to hold the base member 10 stationary with one hand while the lever 14 is actuated with the other hand. In this manner, the portability of the sharpener invention is also enhanced.

The resultant invention provides an improved sharpener for a rotary power lawn mower which is both portable and precise in its operation. The improved sharpener has the precision of a fixed-station sharpening device but is both portable and has fewer moving parts than the prior art.

Although a specific embodiment of the invention has been disclosed, it will become clear to those workers having skill in the art that other alternatives can be used for carrying out the teachings herein without departing from the spirit and the scope of the invention.

What is claimed is:

1. An improved rotary, power lawn mower sharpener, comprising:

a base member having a vertical pivot pin mounted on an upper, horizontal surface thereof;

a lever pivotally mounted on said pivot pin for horizontal motion about said pivot pin, having a handle connected thereto for actuating said lever;

a wedge having a horizontal, planar, bottom surface for sliding engagement with said upper surface of said base, and having an inclined, planar, upper surface, said wedge connected by means of a link element to said lever, said lever acting to displace said wedge in a horizontal direction;

a pair of guide rails mounted on said upper surface of said base, said rails being parallel and spaced apart forming a trough in which said wedge can slide horizontally between said rails;

a tray member pivotally mounted between said pair of rails by means of a horizontal pivot, said tray having a planar, bottom surface adapted for sliding engagement with said inclined, upper surface of said wedge when said wedge is moved horizontally by said lever;

a grinding stone mounted in said tray, having an upper, planar grinding surface which is raised when said wedge moves inwardly beneath said tray and which is lowered when said wedge is moved outwardly from beneath said tray;

said base member being positioned beneath a rotary power lawn mower by rolling the wheels of said mower over said base and moving said handle so that said lever pulls said wedge outwardly from beneath said tray member, lowering said grinding stone so that said upper surface thereof clears the bottom edge of said mower;

said mower having a rotary blade with a leading edge which is to be sharpened, said blade being driven into horizontal motion by means of its motor, said blade being sharpened by moving said handle so that said lever pushes said wedge inwardly beneath said tray member, raising said grinding stone so that said upper surface thereof operatively contacts the lower surface of said leading edge of said blade at an inclined angle;

whereby said blade is conveniently and safely sharpened.

2. The apparatus of claim 1, which further comprises:

a spring means connected between said lever and said base member, for spring biasing said wedge outwardly from beneath said tray.

3. The apparatus of claim 1, which further comprises:

a stop element mounted on said base in spaced relation to said rails, for contacting the side of said mower, to horizontally position said mower and its blade with respect to the horizontal position of said grinding stone.

4. The apparatus of claim 1, which further comprises:

a pair of adjustable stop elements, mounted on said base in spaced relation to said rails, for contacting the side of said mower, to horizontally position said mower and its blade with respect to the horizontal position of said grinding stone;

said pair of stop elements being variably positionable on said base member to accomodate a variety of shapes for said side of said mower.

5. The apparatus of claim 1, which further comprises:

a base handle mounted to said base member, for enabling the operator to hold said base member stationary with one hand while said lever is actuated with the other hand.

6. An improved rotary, power lawn mower sharpener, comprising:

a base member having a pivot mounted thereon;

a lever pivotally mounted on said pivot for horizontal motion about said pivot, having a handle connected thereto for actuating said lever;

a wedge having a horizontal, planar, bottom surface for sliding engagement with said upper surface of said base, and having an inclined, planar, upper surface, said wedge connected to said lever, said lever acting to displace said wedge in a horizontal direction;

a tray member pivotally mounted to said base by means of a horizontal pivot, said tray having a planar, bottom surface adapted for sliding engagement with said inclined, upper surface of said wedge when said wedge is moved horizontally by said lever;

a grinding stone mounted in said tray, having an upper, planar grinding surface which is raised when said wedge moves inwardly beneath said tray and which is lowered when said wedge is moved outwardly from beneath said tray;

said base member being positioned beneath a rotary power lawn mower by rolling the wheels of said mower over said base and moving said handle so that said lever pulls said wedge outwardly from beneath said tray member, lowering said grinding stone so that said upper surface thereof clears the bottom edge of said mower;

said mower having a rotary blade with a leading edge which is to be sharpened, said blade being driven into horizontal motion by means of its motor, said blade being sharpened by moving said handle so that said lever pushes said wedge inwardly beneath said tray member, raising said grinding stone so that said upper surface thereof operatively contacts the lower surface of said leading edge of said blade at an inclined angle;

whereby said blade is conveniently and safely sharpened.

7. The apparatus of claim 6, which further comprises:

a spring means connected between said lever and said base member, for spring biasing said wedge outwardly from beneath said tray.

8. The apparatus of claim 6, which further comprises:

a stop element mounted on said base in spaced relation to said tray, for contacting the side of said mower, to horizontally position said mower and its blade with respect to the horizontal position of said grinding stone.

9. The apparatus of claim 6, which further comprises:

a pair of adjustable stop elements, mounted on said base in spaced relation to said tray, for contacting the side of said mower, to horizontally position said mower and its blade with respect to the horizontal position of said grinding stone;

said pair of stop elements being variably positionable on said base member to accomodate a variety of shapes for said side of said mower.

10. The apparatus of claim 6, which further comprises:

a base handle mounted to said base member, for enabling the operator to hold said base member stationary with one hand while said lever is actuated with the other hand.

* * * * *